US012800185B2

(12) United States Patent
Yang et al.

(10) Patent No.: US 12,800,185 B2
(45) Date of Patent: Nov. 17, 2026

(54) DEVICE FOR CONDENSATE WATER RECOVERY AND ATOMIZATION TO COOL DOWN CONDENSER OF HOUSEHOLD SPLIT AIR CONDITIONER

(71) Applicants: Tianjin Chengjian University, Tianjin (CN); Xi'an University of Architecture and Technology, Xi 'an (CN)

(72) Inventors: Bin Yang, Tianjin (CN); He Li, Tianjin (CN); Pengju Liu, Tianjin (CN); Zeyu Zhao, Tianjin (CN); Yuwen You, Tianjin (CN)

(73) Assignees: Tianjin Chengjian University, Tianjin (CN); Xi'an University of Architecture and Technology, Xi 'an (CN)

( * ) Notice: Subject to any disclaimer, the term of this patent is extended or adjusted under 35 U.S.C. 154(b) by 227 days.

(21) Appl. No.: 18/779,111

(22) Filed: Jul. 22, 2024

(65) Prior Publication Data

US 2025/0137684 A1 May 1, 2025

(30) Foreign Application Priority Data

Nov. 1, 2023 (CN) ..... 202311436366.9

(51) Int. Cl.

| | |
|---|---|
| ***F24F 13/22*** | (2006.01) |
| ***F24F 140/20*** | (2018.01) |
| ***F24F 140/30*** | (2018.01) |

(52) U.S. Cl.

CPC ..... *F24F 13/222* (2013.01); *F24F 2013/225* (2013.01); *F24F 2013/228* (2013.01); *F24F 2140/20* (2018.01); *F24F 2140/30* (2018.01)

(58) Field of Classification Search

CPC ..... F24F 13/222; F24F 2013/225; F24F 1/42; F24F 13/22

(Continued)

(56) References Cited

U.S. PATENT DOCUMENTS 4,170,117 A * 10/1979 Faxon ..... F25B 39/04 248/302
5,311,747 A * 5/1994 Pringle ..... G05D 23/123 62/506

(Continued)

FOREIGN PATENT DOCUMENTS

CN 115013899 A * 9/2022 ..... F24F 3/14
CN 116241952 A * 6/2023 ..... F24F 1/42
KR 102545451 B1 * 6/2023 ..... B05B 13/0278

*Primary Examiner* — Steve S Tanenbaum

(57) ABSTRACT

The invention discloses a device for condensate water recovery and atomization to cool the condenser of a household split air conditioner. Includes: an air conditioner outdoor unit with a drain pipe at the bottom and a condensed water storage tank on top, connected to a condensed water inlet pipe; A filter unit is in the storage tank; The condenser is inside the outdoor unit, with an atomization unit installed directly opposite it. The atomization unit is connected to the storage tank, and a temperature sensing unit is on the condenser. The condensate water inlet pipe connects to the outdoor unit's water pipe. The atomization unit uses purified condensate to cool the condenser in stages, avoiding poor refrigeration and increased compressor power consumption due to high condenser temperature.

8 Claims, 3 Drawing Sheets

(58) Field of Classification Search
USPC ..... 62/506
See application file for complete search history.

(56) References Cited

U.S. PATENT DOCUMENTS

| | | | | |
|---|---|---|---|---|
| 2003/0221440 | A1* | 12/2003 | Limehouse | F24F 1/06 62/305 |
| 2007/0101745 | A1* | 5/2007 | Hsu | F24F 1/42 62/305 |
| 2010/0049338 | A1* | 2/2010 | Schmitt | F24F 1/42 165/104.19 |
| 2020/0271334 | A1* | 8/2020 | Dempsey | F24F 11/85 |
| 2023/0184457 | A1* | 6/2023 | Crabtree | F24F 12/00 165/58 |

* cited by examiner

DEVICE FOR CONDENSATE WATER RECOVERY AND ATOMIZATION TO COOL DOWN CONDENSER OF HOUSEHOLD SPLIT AIR CONDITIONER

BACKGROUND OF THE INVENTION

1. Field of the Invention

The invention relates to the field of condenser cooling of split air conditioners, and in particular to a condenser cooling device for recycling and atomizing condensed water of a household split air conditioner.

2. Description of Related Art

In the prior art, the compressor and condenser of the air conditioner are generally integrated into the outdoor unit. The liquid refrigerant evaporates at low temperature and low pressure and becomes low-temperature and low-pressure vapor, which is then sucked into the compressor and compressed, changing the low-temperature and low-pressure gas into high-temperature and high-pressure vapor. The high-temperature and high-pressure vapor passes through the condenser and releases heat, turning into a high-pressure and normal-temperature liquid. The heat released by the condenser is blown into the air by the fan in the outdoor unit. The more heat the refrigerant dissipates at the condenser, the more heat it absorbs when evaporating when passing through the evaporator, and the better the cooling effect. On the contrary, if the condenser dissipates heat poorly and causes the temperature to be too high, it will affect the overall cooling effect of the air conditioner. Therefore, the lower the temperature of the condenser, the faster the heat dissipation, the better the cooling effect, and the smaller the power consumption of the compressor.

When the air conditioner is operating under cooling conditions, a large amount of condensed water will be produced. Condensed water is liquid water formed by indoor water vapor absorbing heat. Normally, this condensed water is discharged to the outdoors through the air conditioner drain pipe. This condensed water has a low temperature and contains a large cooling capacity, so it is discharged directly, resulting in a waste of resources. Therefore, the present invention proposes an air conditioner condensed water recovery and atomization cooling device for the condenser of a household split air conditioner, so as to use the collected condensed water to assist the heat dissipation of the condenser, reduce the temperature of the condenser, and improve the refrigeration effect of the air conditioner.

SUMMARY OF THE INVENTION

The purpose of the present invention is to provide a condenser water recovery and atomization cooling device for a household split type air conditioner to solve the problems existing in the prior art.

To achieve the above objectives, the present invention provides the following solutions, including:

An air conditioner outdoor unit, with a drain pipe installed at the bottom of the air conditioner outdoor unit;

A condensed water storage tank, the condensed water storage tank is fixedly connected to the top of the air conditioner outdoor unit, and the top of the condensed water storage tank is fixedly connected with a condensed water inlet pipe;

A filtering unit, the filtering unit is arranged in the condensed water storage tank;

A condenser, the condenser is fixedly connected in the air conditioner outdoor unit;

An atomization unit, the atomization unit is arranged inside the air conditioner outdoor unit and is arranged directly opposite the condenser, and the top end of the atomization unit is fixedly connected to the condensed water storage tank;

A temperature sensing unit, the temperature sensing unit is arranged on the condenser;

Control system, the temperature sensing unit and the atomization unit are electrically connected to the control system;

Wherein, the condensed water inlet pipe is fixedly connected with the condensed water pipe of the air conditioner outdoor unit.

In an embodiment, the filter unit includes a PP (polypropylene) cotton filter core layer filter plate and an activated carbon filter plate. The PP cotton filter core layer filter plate and the activated carbon filter plate are arranged in sequence from top to bottom in the condensed water storage tank, and there is a gap between the PP cotton filter core layer filter plate and the activated carbon filter. The PP cotton filter core layer filter plate and the activated carbon filter are detachably connected to the inner wall of the condensed water storage tank.

In an embodiment, the atomization unit includes a metal atomization plate. A water outlet pipe is fixedly connected to the top of the metal atomization plate. A water suction pipe is fixedly connected to the top of the condensed water storage tank. One end of the water suction pipe is fixedly connected with a booster water pump. One end of the water outlet pipe is fixedly connected to the water outlet of the booster water pump. Several rows of atomizing nozzles are arranged at equal intervals on the metal atomizing plate. The atomizing nozzle is arranged corresponding to the condenser.

In an embodiment, a solenoid valve is installed on the water suction pipe.

In an embodiment, a bracket is fixedly connected to the bottom inside the air conditioner outdoor unit. The metal atomization plate and the condenser are both fixedly connected to the bracket.

In an embodiment, the temperature sensing unit includes a contact temperature sensor. Several contact temperature sensors are provided on the condenser.

In an embodiment, several sets of support bases are installed at the bottom of the air conditioner outdoor unit.

In an embodiment, seals are fixedly connected to both ends of the water outlet pipe and the water suction pipe.

In an embodiment, a cleaning port is provided on one side of the condensed water storage tank. A cleaning door is detachably connected to the cleaning port.

In an embodiment, a water level sensor is installed in the condensed water storage tank.

Efficacy can be achieved by the invention is as follows:

1. The household split air conditioner condensed water recovery and atomization cooling device of the present invention realizes the recovery and purification of air conditioner condensed water through the condensed water storage tank and the condensed water inlet pipe. The condensed water generated during the operation of the air conditioner is stored in the condensed water storage tank through the condensed water inlet pipe. The condensed water can be filtered and purified through the built-in filter unit of the storage tank to improve the cleanliness of the condensed water. The risk of condenser scaling, aging and corrosion is greatly reduced.

2. In an embodiment, through the setting of the atomization unit, the purified condensed water can be used to cool the condenser in sections and timely, effectively avoiding poor cooling effect and increase in compressor power consumption caused by excessive condenser temperature.

BRIEF DESCRIPTION OF THE DRAWINGS

In order to more clearly illustrate technical solutions of embodiments of the invention or the prior art, drawings will be used in the description of embodiments or the prior art will be given a brief description below. Apparently, the drawings in the following description only are some of embodiments of the invention, the ordinary skill in the art can obtain other drawings according to these illustrated drawings without creative effort.

Among them, 1. Air conditioner outdoor unit; 2. Condenser; 3. Condensate storage tank; 4. Cleaning door; 5. Condensate water inlet pipe; 6. Support base; 7. Bracket; 8. PP cotton filter element layer filter plate; 9. Activated carbon filter plate; 10. Water level sensor; 11. Metal atomization plate; 12. Contact temperature sensor; 13. Solenoid valve; 14. Water suction pipe; 15. Booster water pump; 16. Water outlet pipe; 17. Fog chemical nozzle.

DETAILED DESCRIPTION OF THE PREFERRED EMBODIMENTS

In the following, with reference to accompanying drawings of embodiments of the invention, technical solutions in the embodiments of the invention will be clearly and completely described. Apparently, the embodiments of the invention described below only are a part of embodiments of the invention, but not all embodiments. Based on the described embodiments of the invention, all other embodiments obtained by ordinary skill in the art without creative effort belong to the scope of protection of the invention.

In order to make the above objects, features and advantages of the present invention more obvious and understandable, the present invention will be described in further detail below with reference to the accompanying drawings and specific embodiments.

Figure 1:
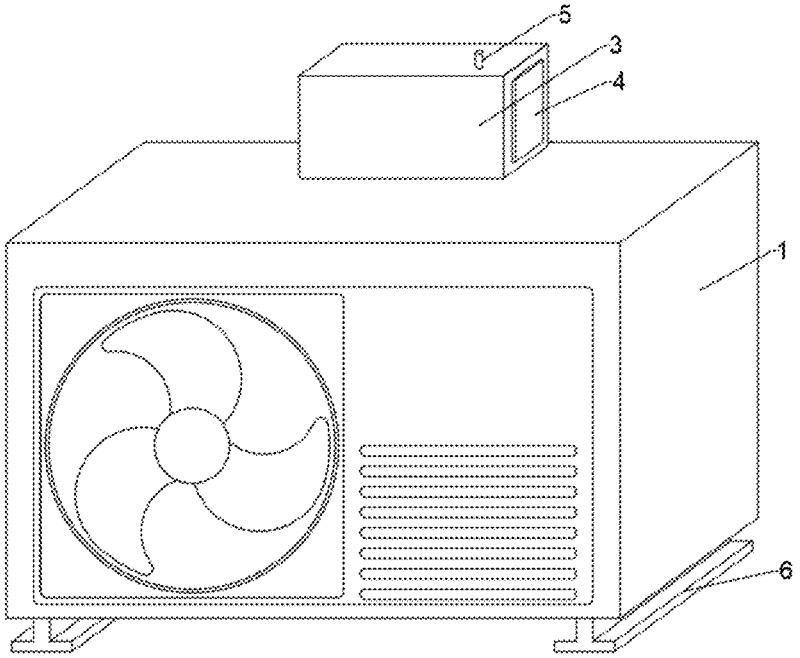
FIG. 1 is an isometric view of the condenser cooling device for the condensed water recovery and atomization of the household split air conditioner of the present invention.
Figure 2:
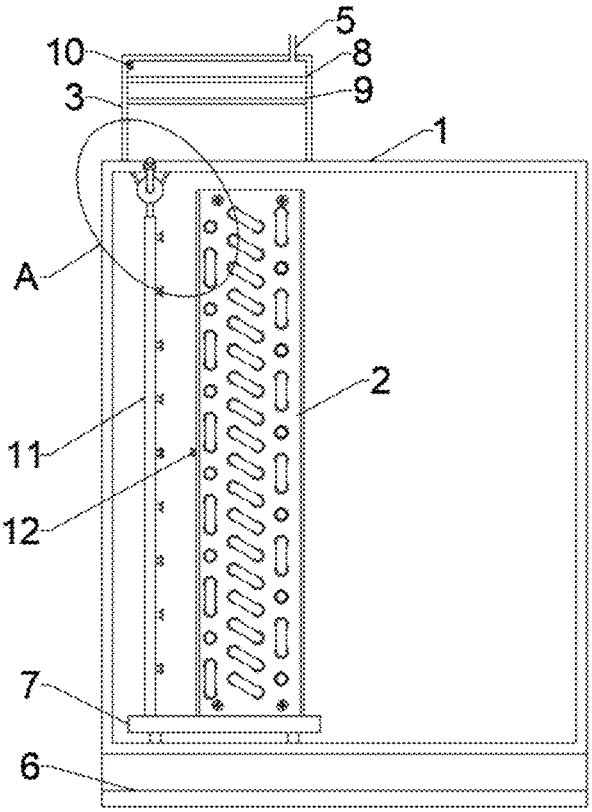
FIG. 2 is a cross-sectional view of the left side view of the condenser cooling device for condensate water recovery and atomization in a household split-type air conditioner according to the present invention.
Figure 3:
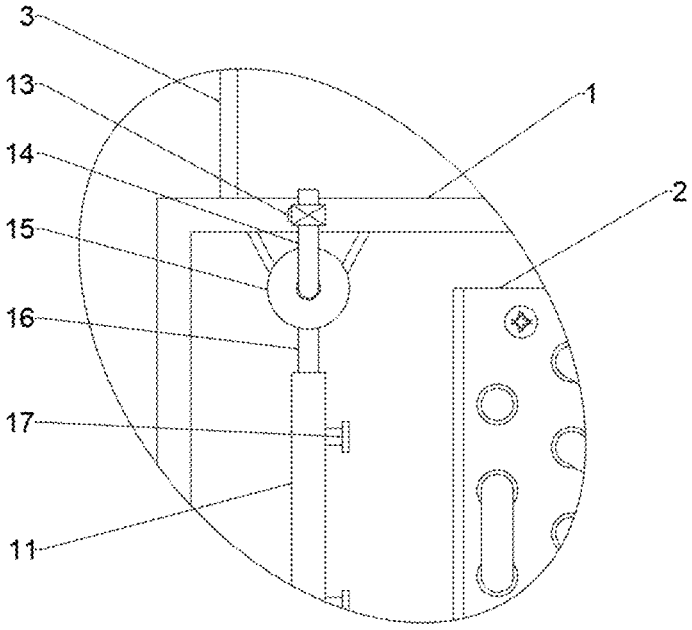
FIG. 3 is an enlarged view of point A in FIG. 2.
Figure 4:
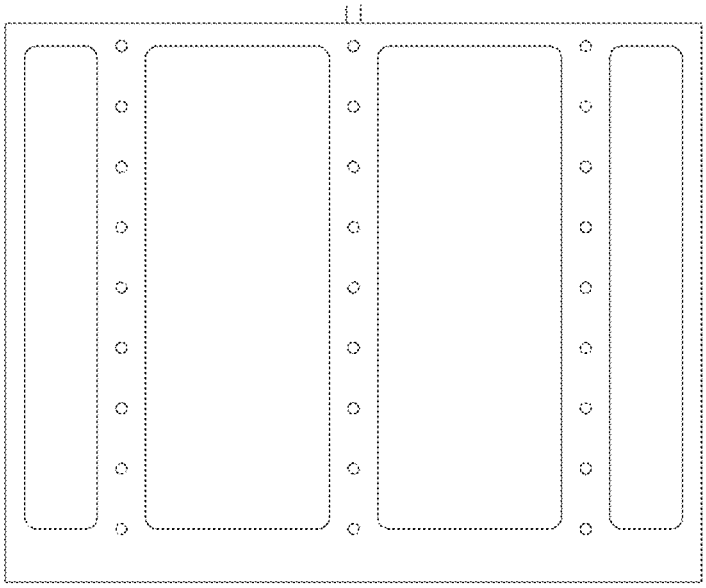
FIG. 4 is a front view of the metal atomization plate of the present invention.

Referring to FIG. 1-4, the present invention provides a household split air conditioner condenser water recovery atomization cooling device, which includes:

The air conditioner outdoor unit 1 has a drain pipe installed at the bottom; The condensed water storage tank 3 is fixedly connected to the top of the air conditioner outdoor unit 1, and the top of the condensed water storage tank 3 is fixedly connected with a condensed water inlet pipe 5; The filter unit is arranged in the condensate storage tank 3; The condenser 2 is fixedly connected to the air conditioner outdoor unit 1; The atomization unit is installed in the air conditioner outdoor unit 1 and is directly opposite the condenser 2. The top of the atomization unit is fixedly connected to the condensed water storage tank 3; The temperature sensing unit is set on the condenser 2; The control system, temperature sensing unit and atomization unit are all electrically connected to the control system; Among them, the condensed water inlet pipe 5 is fixedly connected with the condensed water pipe of the air conditioner outdoor unit 1.

To further optimize the solution, the filtration unit includes a PP cotton filter core layer filter plate 8 and an activated carbon filter plate 9. The PP cotton filter core layer filter plate 8 and the activated carbon filter plate 9 are arranged in sequence from top to bottom in the condensed water storage tank 3, and there is a gap between the PP cotton filter core layer filter plate 8 and the activated carbon filter. Both the PP cotton filter core layer filter plate 8 and the activated carbon filter are detachably connected to the inner wall of the condensed water storage tank 3.

The first layer of PP cotton filter plate 8 can preliminarily filter large particles of impurities in the condensed water; the second layer of activated carbon filter plate 9 can adsorb and filter out some remaining volatile organic compounds in the water. The double-layer filtration of condensed water can effectively improve the cleanliness of the condensed water and effectively slow down the occurrence of scaling, aging, rust and other phenomena in the condenser 2. Moreover, the surface of the activated carbon filter plate 9 becomes alkaline after the carbon activation reaction, which can neutralize the CO2 dissolved in the condensed water and prevent the atomized condensed water from corroding the fins and pipes of the condenser 2.

In a further optimized solution, the atomization unit includes a metal atomization plate 11, and a water outlet pipe 16 is fixedly connected to the top of the metal atomization plate 11. A water suction pipe 14 is fixedly connected to the top of the condensed water storage tank 3, and one end of the water suction pipe 14 is fixedly connected to a booster water pump 15. One end of the water outlet pipe 16 is fixedly connected with the water outlet of the booster water pump 15. Several rows of atomizing nozzles 17 are arranged at equal intervals on the metal atomizing plate 11. The atomizing nozzle 17 is arranged corresponding to the condenser 2.

A plurality of vertical water diversion pipes are fixed in the metal atomization plate 11, and a diverter is fixed in the metal atomization plate 11, and the plurality of water diversion pipes are diverted through the diverter. The diverter is fixedly connected to the water outlet pipe 16, and the spherical water reservoirs are fixed on the water diversion pipe from top to bottom in order, and the size of the spherical water reservoirs decreases in order from top to bottom.

The purified condensed water in the condensed water storage tank 3 flows into the metal atomization plate 11 through the guidance of the water suction pipe 14 and the water outlet pipe 16 through the pressure provided by the booster water pump 15. A plurality of atomization nozzles 17 are integrated on the metal atomization plate 11. There is a water pipe inside the metal atomization plate 11. The metal atomization plate 11 is fixedly installed on the bracket 7 and is located on the side of the condenser 2 away from the fan. Three rows of atomizing nozzles 17 are integrated on the metal atomizing plate 11 in parallel and equidistant directions, and the spray range of the atomizing nozzles 17 just covers the entire condenser 2. The atomizing nozzle 17 sprays the purified condensed water to atomize and cool the condenser 2 to avoid the reduction of the air conditioning refrigeration effect and the increase in compressor power consumption caused by the excessive temperature of the condenser 2 itself during the operation of the air conditioner.

A control system is fixedly installed in the air conditioner outdoor unit 1. The water level sensor 10, the contact temperature sensor 12, the booster water pump 15, the solenoid valve 13 and the control system are electrically connected to the external power line through wires to form a loop. There are three contact temperature sensors 12, and the three contact temperature sensors 12 are respectively installed at the front, middle and rear sections of the condenser 2. The contact temperature sensor 12 transmits the detected temperature signal to the control system, and the control system compares the different operating temperature thresholds set in different areas of the condenser 2 through the signals from different contact temperature sensors 12. When it is found that the temperature of the condenser 2 in a certain section is higher than the set threshold, the control system controls the opening of the booster water pump 15 and the solenoid valve 13. Through the water flow switch built into the metal atomization plate 11, the row of atomization nozzles 17 corresponding to the condenser section 2 with an excessive temperature performs atomization cooling to this section. After detecting that the temperature is lower than the set threshold within a certain range, the control system controls the closing of the booster water pump 15 and the solenoid valve 13. If the water level sensor 10 installed on the top of the condensate storage tank 3 detects that the condensate water level is too high, it will transmit the water level signal to the control system, and the control system controls the opening of the booster water pump 15 and the solenoid valve 13. The three rows of atomizing nozzles 17 start spraying condensed water mist into the condenser 2 at the same time until the condensed water in the condensed water storage tank 3 is emptied. The control method of the booster water pump 15 and the solenoid valve 13 in the present invention is automatically controlled through a control system, which adopts a PLC controller.

To further optimize the solution, a solenoid valve 13 is installed on the water suction pipe 14.

In a further optimized solution, a bracket 7 is fixedly connected to the bottom of the air conditioner outdoor unit 1, and the metal atomization plate 11 and the condenser 2 are both fixedly connected to the bracket 7. A guide groove is provided on the bracket 7, and the water flowing up and down the condenser 2 is guided through the guide groove to avoid water accumulation in the bracket 7. The diversion groove is set in a form with a high center and low ends to improve the diversion effect.

In a further optimized solution, the temperature sensing unit includes a contact temperature sensor 12, and several contact temperature sensors 12 are provided on the condenser 2. The contact temperature sensor 12 adopts a commercially available waterproof contact temperature sensor.

To further optimize the solution, several sets of supporting bases 6 are installed at the bottom of the air conditioner outdoor unit 1.

To further optimize the solution, seals are fixedly connected to both ends of the water outlet pipe 16 and the two ends of the water suction pipe 14. The seal uses a sealant ring to prevent leakage.

To further optimize the solution, a cleaning port is provided on one side of the condensate storage tank 3, and a cleaning door 4 is detachably connected to the cleaning port.

To further optimize the solution, a water level sensor 10 is installed in the condensed water storage tank 3. The water level sensor 10 adopts a waterproof water level sensor available on the market.

Specific Implementation Process:

The condensed water storage tank 3 is fixedly installed on the top of the air conditioner outdoor unit 1. The condensed water storage tank 3 is used to store and collect the condensed water generated during the operation of the air conditioner. The condensed water inlet pipe 5 is fixedly connected to the top of the condensed water storage tank 3 and is used to guide the condensed water generated during the operation and use of the air conditioner into the condensed water storage tank 3 for storage and collection. The water level sensor 10 is fixedly installed inside the condensed water storage tank 3 near the top of the tank. One end of the condensed water inlet pipe 5 is connected to the condensed water storage tank 3 and the other end is connected to the condensed water drain pipe in the air conditioner indoor unit. The horizontal position of the condensed water storage tank 3 on the outdoor unit 1 of the air conditioner should be lower than the indoor unit, otherwise condensed water will backflow. The outer wall of the condensate water inlet pipe 5 is covered with thermal insulation cotton, so that the condensate water cannot easily exchange heat with the outside world when it flows in the condensate water inlet pipe 5 and enters the inside of the condensate water storage tank 3, thereby ensuring that the condensate water can maintain a low temperature. The purification module consists of two layers and is built-in and installed in the condensate storage tank 3. A bracket 7 is fixedly installed inside the air conditioner outdoor unit 1. The condenser 2 and the metal atomization plate 11 are installed on the bracket 7 in parallel. Two supporting bases 6 are fixedly installed at the bottom of the air-conditioning outdoor unit 1. The two supporting bases 6 can be used to stably support and install the air-conditioning outdoor unit 1 at a suitable position on the building exterior wall. The atomization module is integrated on the side of the condenser 2 inside the air conditioner outdoor unit 1 away from the fan. The lower part is fixedly installed on the bracket 7, and the upper part is fixedly installed on the inside of the top of the air conditioner outdoor unit 1. Three contact temperature sensors 12 are fixedly installed on the side of the condenser 2 facing the atomization module. The contact temperature sensors 12 can be used to detect the temperature of the condenser 2 in real time.

In the description of the present invention, it should be understood that the terms 'longitudinal', 'lateral', 'upper', 'lower', 'front', 'rear', 'left', 'right', 'vertical', 'horizontal', 'top', 'bottom', 'inner', 'outer', etc. are based on the orientation or positional relationship shown in the drawings, is only for the convenience of describing the present invention, and does not indicate or imply that the device or element referred to must have a specific orientation, be constructed and operated in a specific orientation, and therefore cannot be construed as a limitation of the present invention.

While the invention has been described in terms of what is presently considered to be the most practical and preferred embodiment, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A device for condensate water recovery and atomization to cool down a condenser of a household split air conditioner, comprising:

an air conditioner outdoor unit (1), with a drain pipe installed at a bottom of the air conditioner outdoor unit (1);

a condensate water storage tank (3), fixedly connected to a top of the air conditioner outdoor unit (1), wherein a top of the condensed water storage tank (3) is fixedly connected to a condensed water inlet pipe (5);

a filter unit, arranged in the condensed water storage tank (3);

the condenser (2), fixedly connected in the air conditioner outdoor unit (1);

three contact temperature sensors (12), respectively installed at a front section, a middle section and a rear section of the condenser (2);

an atomization unit, arranged inside the air conditioner outdoor unit (1) and arranged directly opposite the condenser (2), wherein a top end of the atomization unit is fixed to the condensed water storage tank (3), and the atomization unit comprises a metal atomization plate (11) and a plurality of atomizing nozzles (17) disposed on the metal atomization plate (11), the metal atomization plate (11) is located on a side of the condenser (2) installed with the three contact temperature sensors (12), and the plurality of atomizing nozzles (17) are distributed on the metal atomization plate (11) corresponding to the front section, the middle section and the rear section of the condenser (2); and a programmable logic controller (PLC), wherein the three contact temperature sensors (12) and the atomization unit are electrically connected to the PLC, and the PLC is configured to compare different operating temperature thresholds set in different sections of the condenser (2) with temperature signals detected from the three contact temperature sensors (12), and control the plurality of atomizing nozzles (17) corresponding to a section of the condenser (2) whose temperature exceeds a corresponding operating temperature threshold of the section of the condenser (2) to perform atomization cooling on the section of the condenser (2).

2. The device as claimed in claim 1, wherein supporting bases (6) are installed at the bottom of the air conditioner outdoor unit (1).

3. The device as claimed in claim 1, wherein a cleaning port is provided on one side of the condensate storage tank (3), and a cleaning door (4) is detachably connected to the cleaning port.

4. The device as claimed in claim 1, wherein the filter unit comprises a polypropylene (PP) cotton filter core layer filter plate (8) and an activated carbon filter plate (9), the PP cotton filter core layer filter plate (8) and the activated carbon filter plate (9) are arranged in sequence from top to bottom in the condensed water storage tank (3), a gap is defined between the PP cotton filter core layer filter plate (8) and the activated carbon filter, and the PP cotton filter core layer filter plate (8) and the activated carbon filter are detachably connected to an inner wall of the condensate storage tank (3).

5. The device as claimed in claim 4, wherein a water level sensor (10) is installed in the condensed water storage tank (3), and is located above the PP cotton filter core layer filter plate (8).

6. The device as claimed in claim 1, wherein a water outlet pipe (16) is fixedly connected to a top of the metal atomization plate (11); a water suction pipe (14) is fixedly connected to the top of the condensed water storage tank (3); one end of the water suction pipe (14) is fixedly connected with a booster water pump (15); one end of the water outlet pipe (16) is fixedly connected to a water outlet of the booster water pump (15).

7. The device as claimed in claim 6, wherein a solenoid valve (13) is installed on the water suction pipe (14).

8. The device as claimed in claim 6, wherein a bracket (7) is fixedly connected to a bottom inside the air conditioner outdoor unit (1), and the metal atomization plate (11) and the condenser (2) are both fixedly connected to the bracket (7).

* * * * *